340-552 SR

8/26/80 OR 4,219,802

United States Patent [19]

Ceseri

[11] 4,219,802

[45] Aug. 26, 1980

[54] SCANNING BARRIER FOR THE DISCRIMINATION AND COUNTING OF OBJECTS AND MORE SPECIFICALLY OF VEHICLES IN TRANSIT THROUGH A LAMINAR BARRAGE OF ELECTROMAGNETIC MICROWAVES

[75] Inventor: Pierluigi Ceseri, Florence, Italy

[73] Assignee: "Autostrade"-Concessioni e Costruzioni Autostrade S.p.A., Rome, Italy

[21] Appl. No.: 697,451

[22] Filed: Jun. 18, 1976

[30] Foreign Application Priority Data

Jun. 19, 1975 [IT] Italy ..... 50133 A/75

[51] Int. Cl.[2] ..... G08B 13/24; G08G 1/01

[52] U.S. Cl. ..... 340/552; 340/38 R; 343/771

[58] Field of Search ..... 340/38 R, 38 D, 258 B, 340/258 D, 258 R, 553, 552; 343/711, 755, 770, 834, 833, 767, 112 TC, 5 PD, 771; 250/209, 221

[56] References Cited

U.S. PATENT DOCUMENTS

| | | | |
|---|---|---|---|
| 2,026,652 | 1/1936 | Ponte | 343/834 |
| 2,366,152 | 12/1944 | Lauterbach | 340/38 P |
| 2,840,818 | 6/1958 | Reed et al. | 343/770 |
| 2,965,893 | 12/1960 | Barker | 340/38 R |
| 3,614,729 | 10/1971 | Fujimoto et al. | 340/38 R |
| 3,728,630 | 4/1973 | Strenglein | 343/6.8 R |
| 3,742,222 | 6/1973 | Endl | 340/258 B |
| 3,805,061 | 4/1974 | DeMissimy et al. | 340/258 B |
| 3,858,043 | 12/1974 | Sick et al. | 340/258 B |
| 3,877,002 | 4/1975 | Cheal et al. | 343/5 PD |
| 3,896,414 | 7/1975 | Rulo | 340/38 P |
| 4,027,303 | 5/1977 | Neuwirth et al. | 340/258 D |
| 4,079,361 | 3/1978 | Woode | 343/5 PD |

FOREIGN PATENT DOCUMENTS

| | | | |
|---|---|---|---|
| 2502610 | 7/1975 | Fed. Rep. of Germany | 340/258 B |

OTHER PUBLICATIONS

"Radar, Acoustic, and Magnetic Vehicle Detectors", Barker, IEEE Transactions, 2-70, pp. 30-43.

*Primary Examiner*—John W. Caldwell, Sr.
*Assistant Examiner*—James J. Groody

[57] ABSTRACT

A scanning barrier which can detect and discriminate objects which are within the scanned area. A transmitter on one side of the scanned area transmits a laminar barrage of electromagnetic microwaves across the scanned area. The laminar barrage of electromagnetic microwaves have a thin width and a predetermined height. A receiver across the scanned area receives the microwaves. The receiver is formed of a plurality of vertically adjacent elemental receivers which divide the laminar barrage into a series of horizontal slices. A logic circuit is connected to each of the elemental receivers and can detect the interruption of the laminar barrage to that elemental receiver.

9 Claims, 5 Drawing Figures

SCANNING BARRIER FOR THE DISCRIMINATION AND COUNTING OF OBJECTS AND MORE SPECIFICALLY OF VEHICLES IN TRANSIT THROUGH A LAMINAR BARRAGE OF ELECTROMAGNETIC MICROWAVES

Scanning barriers are known which are able to achieve a thin laminar barrage of the order of one to some tens of centimeters and having a determined height, chosen at will, as a function of the kind of utilization for which said barriers are intended.

In said known barriers, the laminar barrage, or lamina, generally consists of focalized optical beams suitably modulated, as for instance infrared rays, lasers, photocells and/or similar beams. The output signal is generated by a free potential contact, normally open, which can close whenever an interruption of the lamina takes place due to the passage of a vehicle.

Such barriers offer the drawback that they are jammed by the sunlight and consequently they are not very reliable for outdoor applications.

The present invention concerns a new kind of barrier for discrimination and counting of moving objects and more specifically of vehicles in transit. The barrier is suitable to realize an electromagnetic wave barrage, which is as thin as desired and has a pre-determined height, and is absolutely insensitive to sunlight and/or wheather disturbances. It is particularly able to register data at determined strategic points of a road stretch equipped with a system for electronic traffic control in real time, for instance at entrances and exits and/or at the branching points of an highway, where it is desirable that the discrimination of vehicles in transit and their counting be safely reliable.

The device which is the object of the present invention is characterised by a degree of high reliability, due to the fact that mechanical moving parts are not required.

Such device, or barrier, essentially consists of a transmitter, having the function of realizing the laminar barrage of electromagnetic waves, and of a receiver provided by a plurality of elemental receivers superimposed one upon the other and connected with a logical circuit. The receivers are able to register the attenuation or interruption of the laminar barrage whenever the horizontal barrage-slice corresponding to each of them is crossed by a moving body.

Further features and advantages of the invention will appear as a result of the following description with reference to the accompanying drawing, wherein, as an indicative but non-limiting example, a preferred embodiment of the invention is represented.

Figure 1:
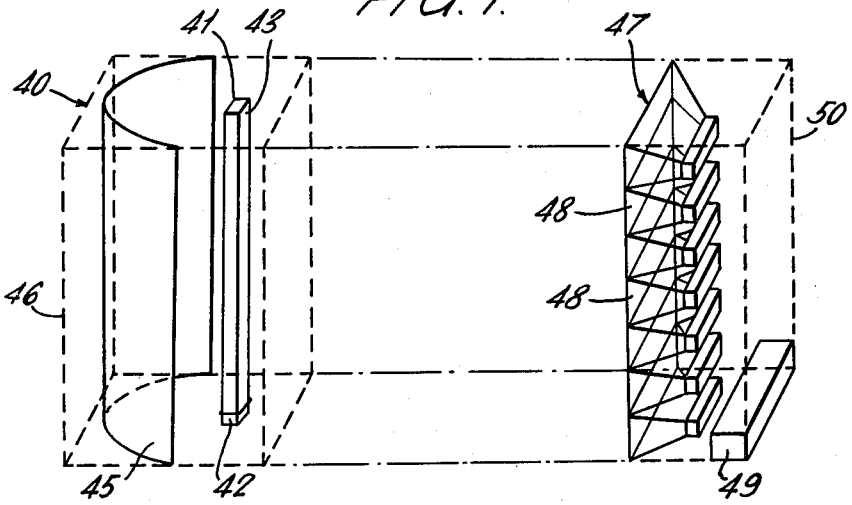
FIG. 1 shows, in a schematic representation, an axinometric view of a barrier, together with its own transmitter and receiver, according to the present invention.
Figure 2:
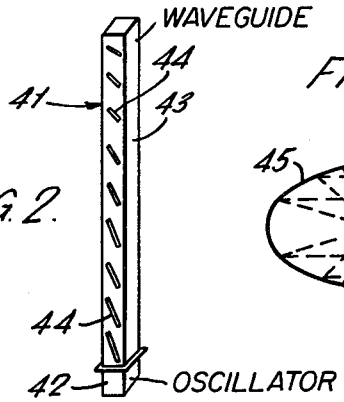
FIG. 2 shows, in a schematic representation, a axinometric view of a slit weveguide illuminator, from the side of the slit face, coupled with a Gun diode oscillator, according to the present invention.
Figure 3:
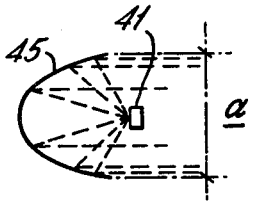
FIG. 3 shows, in a schematic representation, a top view of a slit waveguide illuminator, together with its cylindrical-parabolic reflector, according to the present invention.
Figure 4:
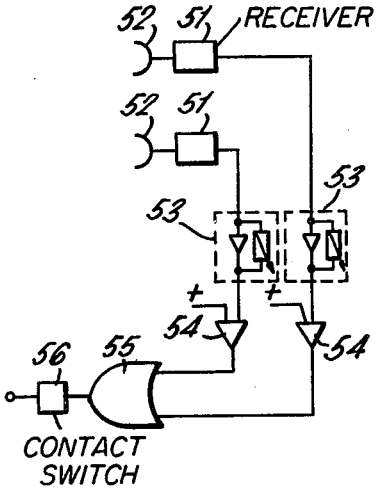
FIG. 4 shows a block diagram of a receiver of a barrier according to the present invention, wherein, for clarity sake in the drawing, only two elemental receivers are shown.
Figure 5:
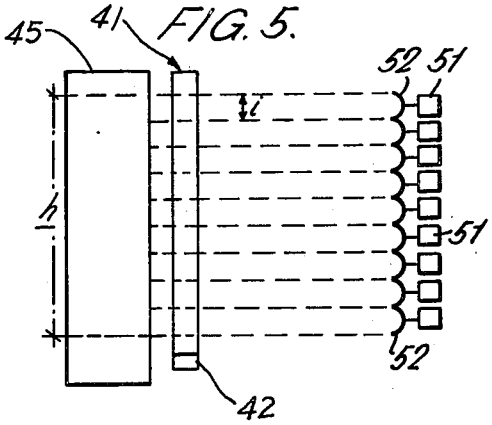
FIG. 5 shows, in a schematic representation, a side view of the barrier according to the present invention, which consists of a transmitter and nine elemental receivers.

As FIG. 1 shows, transmitter 40 is substantially composed of an illuminator 41, which is realized through the coupling of a Gun diode oscillator 42, operating at millimeter wavelength range, with a waveguide 43 having transversal slits 44 fanlike arranged, in such a way that through each slit 44 a constant portion of the generated power is emitted, in order to obtain an even wave front having a constant phase.

Such illuminator 41 is situated at the focus of a cylindrical-parabolic reflector 45, provided, by way of example by a smooth metal surface, so that the wave beam emitted by the illuminator 41 will be reflected parallel to the axis of the parabola generatrix of the reflector itself, thereby forming a beam having a thickness a, corresponding to the length of the chord of the parabola, and an height h, which is determined by the height of the illuminating unit composed of 41 and 45 and enclosed within a container 46 having the function of a support, and represented in figure, by a dashed line.

The division of the receiver 47 into a plurality of elemental receivers 48 has the purpose of separating the controlled area into horizontal sections, or slices, with the purpose of achieving the sensitivity required to survey even small size bodies crossing the barrage, as for instance the drawbar which ties a trailer to its tractor.

If the receiver consists of a single receiver-unit, as in the case of known receivers, for instance the radio-frequency receivers, the low sensitivity of the device could give erroneous results. For instance in the case of a trailer truck, i.e. of a tractor together with its trailer, there would result a signal representing the passage of two distinct and separated vehicles, thereby deceiving the analyser about the effective number of vehicles passing across the barrage.

On the contrary, through the partialization of the area of the controlled surface into a number of horizontal slices which are liable to sensitize at least one elemental receiver, the passing body, which in this case is the drawbar, is surely detected thereby giving a continuity to the signal which corresponds to the passage of only one vehicle, i.e. a trailer truck.

Each elemental receiver 48 is composed of a crystal-video receiver 51 tuned to the frequency of the transmitter 40 and of a low-gain horn antenna 52, preferably but not exclusively with an aperture angle of about 70°.

The height of the antenna 52 determines the height i of the effectively interested area, or slice, of each elemental receiver 48.

Such height i must be comparable with the minimum size of the body which is to be surveyed. For instance, in the case of the application to the counting of vehicles in transit, such dimension is defined by the height of the drawbar tying the tractor with the trailer, and appears to be of the order of 10–12 centimeters.

The direct voltage at the output of each elemental receiver, duly amplified through a controllable amplifier 53, is applied to a threshold comparator 54.

The gain of amplifier 53 is controlled in such a way to compensate for eventually not absolutely perfect homogeneity of the signal picked up along the whole wave front at the various heights. A NOR logical circuit, indicated at 55, effects the function of controlling the state of all elemental receivers 48 and gives origin to the output signal driving a normally open free potential contact 56. The output signal is suitable to close the contact due to the detection of an interruption of the barrage lamina, by having at least one of the elemental receivers effected by an attenuation of the received signal beyond the prefixed threshold level.

In practice, a device according to the present invention, perticularly suited for the counting of vehicles in transit, is advantageously composed of a transmitter 40, having an antenna of a height of one meter, and of a receiver 47 which is divided into nine sections, or slices, each of them having a height of approximately eleven centimeters.

The height i of the area of real interest of each elemental receiver 48 appears, thus, to be equal to twelve centimeters approximately, and the device is sensitive to the passage of bodies having a height of about eight centimeters.

It is feasible to vary the sensitivity of the barrier as a function of the height, by controlling the gain of the received signal amplifier, and by varying the aperture angle of the receiving horn.

I claim:

1. A scanning barrier for detecting objects in a scanned area, comprising a transmitter for transmitting across the scanned area a laminar barrage of electromagnetic microwaves having a thin width and a defined height, and a receiver for receiving said transmitted microwaves crossing the scanned area, said transmitter comprising an illuminator comprised of an oscillator for producing a wave beam operating at the millimeter wavelength range and a slit wave guide coupled to said oscillator, said slit wave guide having slits in a fan-like arrangement, whereby each of the slits emits a constant portion of the generated power of the wave beam to obtain an even wave front having a constant phase, said receiver being formed of a plurality of separate and individual vertically adjacent elemental receivers, each elemental receiver receiving a horizontal slice of the laminar barrage, each of said elemental receivers comprising a low gain horn antenna for receiving the horizontal slice of the laminar barrage, a crystal video receiver respectively coupled to each of said horn antennas and circuit means respectively coupled to each output of a respective crystal video receiver whereby each of said elemental receivers produces a direct voltage output corresponding to the interruption of the laminar barrage to that elemental receiver by an object in the area, and wherein the sensitivity of the barrier is dependent upon the aperture angle of each of said horn antennas.

2. A scanning barrier as in claim 1 and wherein said oscillator is a Gunn diode oscillator.

3. A scanning barrier as in claim 1 and wherein said transmitter further comprises a cylindrical parabolic reflector, said illuminator placed at the focal line of said reflector, said reflector reflecting the wave beam emitted from the illuminator in a direction parallel to the axis of the parabolic generatrix, whereby the reflected wavebeam has a width equal to the length of the parabolic chord and a height equal to the height of said illuminator.

4. A scanning barrier as in claim 3 and wherein the parabolic reflector comprises a smooth metal surface, and the slit waveguide has its slits facing toward the apex of said parabolic reflector.

5. A scanning barrier as in claim 1 and wherein the aperture angle of the low gain horn antenna of each said elemental receivers is approximately 70°.

6. A scanning barrier as in claim 1 and wherein the height of each horizontal slice of said laminar barrage is defined as height i and is determined by the height of the corresponding horn antenna, said height i being comparable to the minimum height dimensions of the object to be detected.

7. A scanning barrier as in claim 1, and wherein each of said circuit means comprises an amplifier receiving the output from the crystal video receiver, the gain of the amplifier being controlled to compensate for the imperfect homogeneity of the wave received at the different heights of the elemental receivers, a threshold detector respectively coupled to each amplifier output, and further comprising a gating circuit receiving the output from all of the threshold detectors, and a switch means controlled by the output from said gating circuit to provide an output indication upon the detection of a reduced amount of the microwaves by at least one of the elemental receivers caused by an object which blocks the microwaves thereby causing an attentuation of the amplifier output beyond a predetermined threshold of the threshold detector.

8. A scanning barrier as in claim 7 and wherein the sensitivity of the barrier is controlled by adjusting the gain of the amplifiers.

9. A scanning barrier as in claim 1 and wherein said transmitter and receiver are in alligned positions across from each other on either side of the scanned area, and further comprising housing means respectively containing said transmitter and receiver.

* * * * *